US006471322B2

(12) United States Patent
Kanda et al.

(10) Patent No.: US 6,471,322 B2
(45) Date of Patent: Oct. 29, 2002

(54) INK-JET RECORDING METHOD AND INK-JET RECORDING APPARATUS

(75) Inventors: Hidehiko Kanda, Kanagawa (JP); Jiro Moriyama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/735,807

(22) Filed: Dec. 14, 2000

(65) Prior Publication Data

US 2001/0015734 A1 Aug. 23, 2001

(30) Foreign Application Priority Data

Dec. 17, 1999 (JP) ..... 11-358799

(51) Int. Cl.[7] ..... B41J 2/205
(52) U.S. Cl. ..... 347/15; 347/43
(58) Field of Search ..... 347/15, 12, 40, 347/41, 43

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato | 347/10 |
| 4,459,600 A | | 7/1984 | Sato | 347/47 |
| 4,463,359 A | | 7/1984 | Ayata | 347/56 |
| 4,558,333 A | | 12/1985 | Sugitani | 347/65 |
| 4,723,129 A | | 2/1988 | Endo | 347/56 |
| 4,740,796 A | | 4/1988 | Endo | 347/56 |
| 5,023,630 A | | 6/1991 | Moriyama | 347/68 |
| 5,343,227 A | | 8/1994 | Hirosawa | 347/42 |
| 5,646,659 A | | 7/1997 | Moriyama | 347/55 |
| 5,798,776 A | * | 8/1998 | Uchiyama et al. | 347/43 |
| 6,030,065 A | * | 2/2000 | Fukuhata | 347/15 |
| 6,084,604 A | * | 7/2000 | Moriyama et al. | 347/43 |
| 6,092,887 A | * | 7/2000 | Tanino et al. | 347/40 |
| 6,149,260 A | * | 11/2000 | Minakuti | 347/15 |

FOREIGN PATENT DOCUMENTS

| | | |
|---|---|---|
| JP | 59-123670 | 7/1984 |
| JP | 59-138461 | 8/1984 |

* cited by examiner

*Primary Examiner*—Lamson Nguyen
(74) *Attorney, Agent, or Firm*—Fitzpatrick, Cella, Harper & Scinto

(57) ABSTRACT

An ink-jet recording method includes the steps of recording black circles of a black ink ejected by black ink nozzles at the positions corresponding to a resolution of, for example, 600 dpi, and recording black dots of the black ink formed by selectively mixing cyan, magenta, and yellow inks at the positions offset by a distance corresponding to a resolution of 1200 dpi, thereby forming a black image having high resolutions, whereby the black image can be recorded at a high speed and with high resolutions.

16 Claims, 15 Drawing Sheets

300
CPU
301
ROM
302
RAM
303
IMAGE INPUT UNIT
304
IMAGE SIGNAL PROCESSING UNIT
305
MAIN BUS LINE
306
OPERATION UNIT
307
RESTORING-CONTROL CIRCUIT
308
RESTORING MOTOR
309
BLADE
310
CAP
311
SUCTION PUMP
312
THERMISTOR
313
HEATER
RECORDING HEAD UNIT
314
HEAD-TPERATURE CONTROL CIRCUIT
315
HEAD-DRIVING CONTROL CIRCUIT
316
CARRIAGE-DRIVING CONTROL CIRCUIT
317
SHEET-TRANSFER CONTROL CIRCUIT

BLACK DOTS RECORDED WITH BLACK INK BY FIRST RECORDING METHOD

BLACK DOTS RECORDED WITH BLACK INK BY SECOND RECORDING METHOD

BLACK DOTS RECORDED WITH MIXTURE SELECTIVELY USING YELLOW, MAGENTA, AND CYAN INKS BY SECOND RECORDING METHOD

INK-JET RECORDING METHOD AND INK-JET RECORDING APPARATUS

BACKGROUND OF THE INVENTION

1. Field of the Invention

The present invention relates to an ink-jet recording apparatus which ejects ink from a recording device to a recording medium and records thereon.

2. Description of the Related Art

Hitherto, recording apparatuses serving as printers, copying machines, and facsimile machines or those used as output apparatuses such as integrated-type electronic apparatuses and workstations including computers, word processors, and the like have been formed in which images including characters and the like are recorded on recording media such as paper sheets and plastic films in accordance with image data including character data. The recording apparatuses are categorized into ink-jet types, wire-dot types, thermal types, laser-beam types, and the like. An ink-jet-type recording apparatus (hereinafter referred to as an ink-jet recording apparatus) records on a recording medium by ejecting ink thereto from a recording device (recording head) and has a characteristic superior to the other types in that high precision can be easily obtained, a high-speed and quiet operation can be performed, and it can be manufactured at a low cost. Various color ink-jet recording apparatuses have been developed in response to increasing requirements for color recording apparatuses. In order to increase the recording speed, the ink-jet apparatus generally includes a recording head formed with a plurality of integrated recording devices in which a plurality of integrated ink-nozzles and liquid paths are used for ejecting ink, and includes a plurality of the recording heads for a plurality of colors.

FIGS. 1 shows a printer in which the recording head prints a recording sheet. Ink cartridges 101 are shown in the drawing. Each ink cartridge 101 includes an ink tank containing black, cyan, magenta, or yellow ink, and a recording head 102. FIG. 2 shows a plurality of ink nozzles 201, viewed in the Z-direction, disposed on each recording head 102. In FIG. 1, a sheet-transfer roller 103 and an assist roller 104 rotate in directions of arrows shown in the drawing so as to transfer a sheet P in the Y-direction by holding the same. Sheet-feeding rollers 105 feed recording sheets while holding the sheet P in the same manner as the rollers 103 and 104. A carriage 106 supports four ink cartridges 101 and moves the same while printing. The carriage 106 waits in a home position h shown by a dotted line in the drawing when printing is not performed or the recording heads are restored.

The carriage 106 disposed at the home position h before printing starts to move in the X-direction in response to a printing command, and performs printing by ejecting ink through a plurality of the ink nozzles 201 disposed on the recording heads 102. The carriage 106 is restored to the home position when printing of data is completed at the other end of the recording sheet and starts again printing in the X-direction.

A method, for recording in a black-and-white mode at a speed higher than that in a color mode by using the same recording head which has the same number of ink nozzles having the same distance therebetween and using the same black and other colors described above, is disclosed in, for example, Japanese Patent No. 2652405. In the method, a high speed recording is possible without increasing the driving frequency of the recording heads by performing recording in a primary scanning direction (the X-direction) alternately in black with a recording head ejecting black ink and in black with recording heads ejecting other color inks of which a mixture forms a black colored ink.

However, smaller ink droplets must be ejected and the density of recording pixels must be increased in order to reduce jagged edges and dots of black characters and the like and to increase levels of gradation of black color for outputting more photograph-like color images of higher quality.

A method to meet with these requirements is considered in that the amount of ink ejection is reduced by using recording heads having the same number of ink nozzles and the same nozzle density of 300 dpi or 600 dpi as of known recording heads. However, in this method, the recording speed is reduced compared with a known method because the number of movements in a primary scanning direction must be increased so as to fill in gaps in a secondary scanning direction.

Another method is considered in that the amount of ink ejection is reduced by using recording heads having an increased number of ink nozzles so as to have the same width of recording line as that of the known recording heads and an increased nozzle density of 1200 dpi. Although in this method, the recording speed is not reduced, manufacturing costs are increased significantly because the number of ink nozzles is increased by twice of four times that of the known recording heads.

SUMMARY OF THE INVENTION

Accordingly, it is an object of the present invention to provide an ink-jet recording apparatus in which high-resolution images can be recorded without reducing the recording speed for black images.

To this end, according to an aspect of the present invention, an ink-jet recording apparatus for performing recording by ejecting ink onto a recording medium while moving a recording head relative to the recording medium in a scanning direction comprises a first nozzle unit including a plurality of nozzles for ejecting black ink disposed in line in a direction different from the scanning direction; and a second nozzle unit including a plurality of nozzles for ejecting colored inks disposed in line in a direction different from the scanning direction and at a density higher than a density of the nozzles included in the first nozzle unit, the plurality of nozzles for ejecting colored inks being capable of forming black ink by mixing colored inks. The first nozzle unit records a black image and the second nozzle unit records with a mixture of colored inks ejected by the second nozzle unit in a region of the black image in which recording is not performed by the first nozzle unit, whereby the black image is recorded with a resolution higher than a resolution of the black image when recorded only by the first nozzle unit.

According to another aspect of the present invention, an ink-jet recording apparatus for performing recording by ejecting ink onto a recording medium while moving a recording head relative to the recording medium in a scanning direction comprises a first nozzle unit including a plurality of nozzles for ejecting black ink disposed in line in a direction different from the scanning direction; and a second nozzle unit including a plurality of nozzles for ejecting colored inks disposed in line in a direction different from the scanning direction and at a density higher than a density of the nozzles included in the first nozzle unit, the plurality of nozzles for ejecting colored inks being capable of forming black ink by mixing colored inks. Recording is selectively performed in one of a first recording mode in which a black image is recorded by the first nozzle unit and a second recording mode in which the first nozzle unit records the black image and the second nozzle unit records with a mixture of colored inks ejected by the second nozzle unit, in a region of the black image in which recording is not performed by the first nozzle unit, whereby the black image is recorded with a resolution higher than a resolution of the black image when recorded only by the first nozzle unit.

According to still another aspect of the present invention, an ink-jet recording apparatus for performing recording by ejecting ink onto a recording medium while moving a recording head relative to the recording medium in a scanning direction comprises a first nozzle unit including a plurality of nozzles for ejecting black ink disposed in line in a direction different from the scanning direction; and a second nozzle unit including a plurality of nozzles for ejecting colored inks disposed in line in a direction different from the scanning direction and at a density higher than a density of the nozzles included in the first nozzle unit, the plurality of nozzles for ejecting colored inks being capable of forming black ink by mixing colored inks. A region of a black image capable of being recorded by the first nozzle unit is recorded with black ink ejected by the first nozzle unit and with a mixture of colored inks ejected by the second nozzle unit, and a remaining region of the black image which is not recorded by the first nozzle unit is recorded with the mixture of colored inks ejected by the second nozzle unit, whereby the black image is recorded with a resolution higher than a resolution of the black image when recorded only by the first nozzle unit.

According to yet another aspect of the present invention, an ink-jet recording apparatus for performing recording by ejecting ink onto a recording medium while moving a recording head relative to the recording medium in a scanning direction comprises a first nozzle unit including a plurality of nozzles for ejecting black ink disposed in line in a direction different from the scanning direction; and a second nozzle unit including a plurality of nozzles for ejecting colored inks disposed in line in a direction different from the scanning direction and at a density higher than a density of the nozzles included in the first nozzle unit, the plurality of nozzles for ejecting colored inks being capable of forming black ink by mixing colored inks. Recording is selectively performed in one of a first recording mode in which a black image is recorded only by the first nozzle unit and a second recording mode in which a region of the black image capable of being recorded by the first nozzle unit is recorded with black ink ejected by the first nozzle unit and with a mixture of colored inks ejected by the second nozzle unit, and a remaining region of the black image which is not recorded by the first nozzle unit is recorded with the mixture of colored inks ejected by the second nozzle unit, whereby the black image is recorded with a resolution higher than a resolution of the black image when recorded only by the first nozzle unit.

According to a further aspect of the present invention, an ink-jet recording method for performing recording by ejecting ink onto a recording medium while moving a recording head relative to the recording medium in a scanning direction comprises the steps of providing a first nozzle unit including a plurality of nozzles for ejecting black ink disposed in line in a direction different from the scanning direction, and a second nozzle unit including a plurality of nozzles for ejecting colored inks disposed in line in a direction different from the scanning direction and at a density higher than a density of the nozzles included in the first nozzle unit, the plurality of nozzles for ejecting colored inks being capable of forming black ink by mixing colored inks; and recording a black image by the first nozzle unit and recording in a region of the black image in which recording is not performed by the first nozzle unit by the second nozzle unit with a mixture of colored inks ejected by the second nozzle unit, whereby the black image is recorded with a resolution higher than a resolution of the black image when recorded only by the first nozzle unit.

Further objects, features and advantages of the present invention will become apparent from the following description of the preferred embodiments with reference to the attached drawings.

DESCRIPTION OF THE PREFERRED EMBODIMENTS

Embodiments according to the present invention are described below with reference to the drawings.

Figure 1:
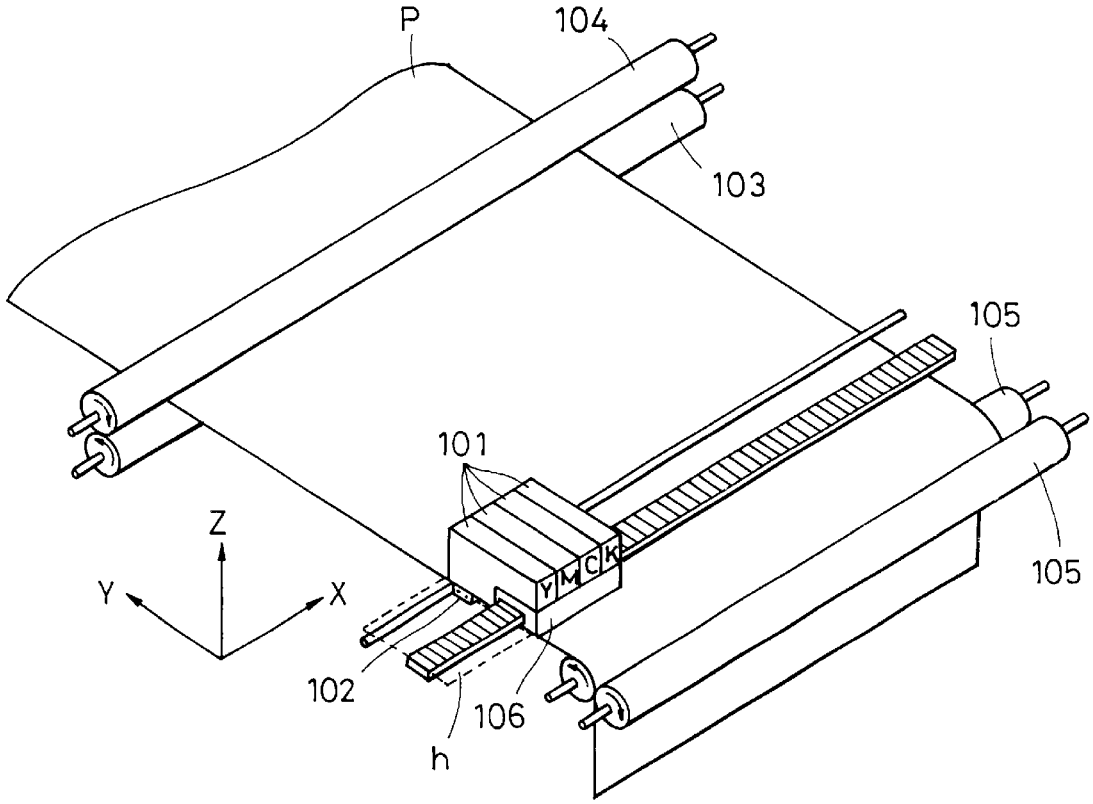
FIG. 1 is a perspective view showing the configuration of an ink-jet recording apparatus according to the present invention.
Figure 2:
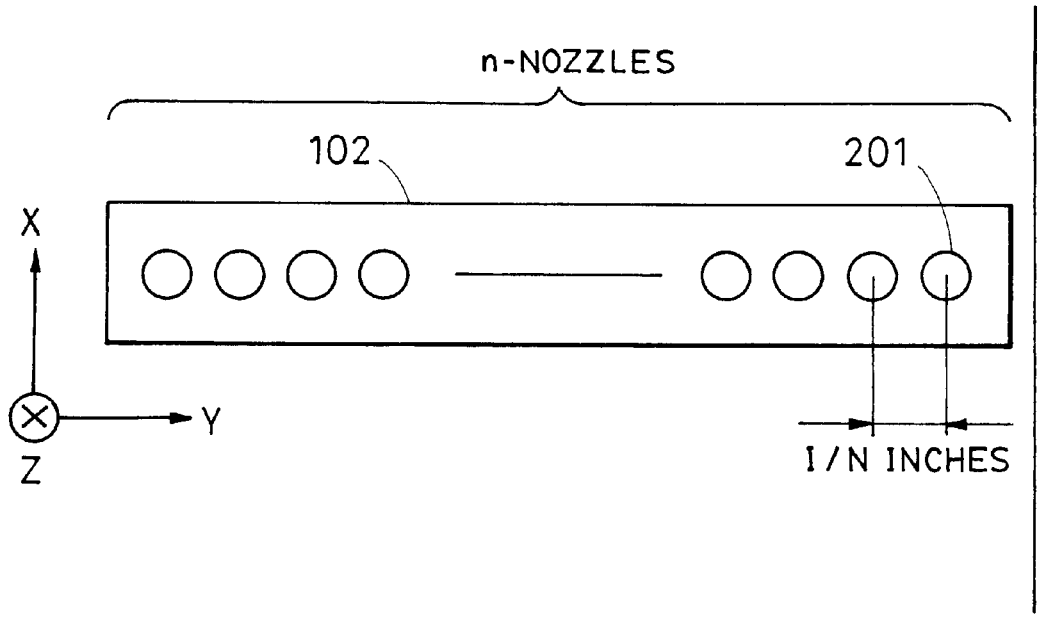
FIG. 2 is an illustration of a portion of a recording head of the ink-jet recording apparatus shown in FIG. 1.
Figure 3:
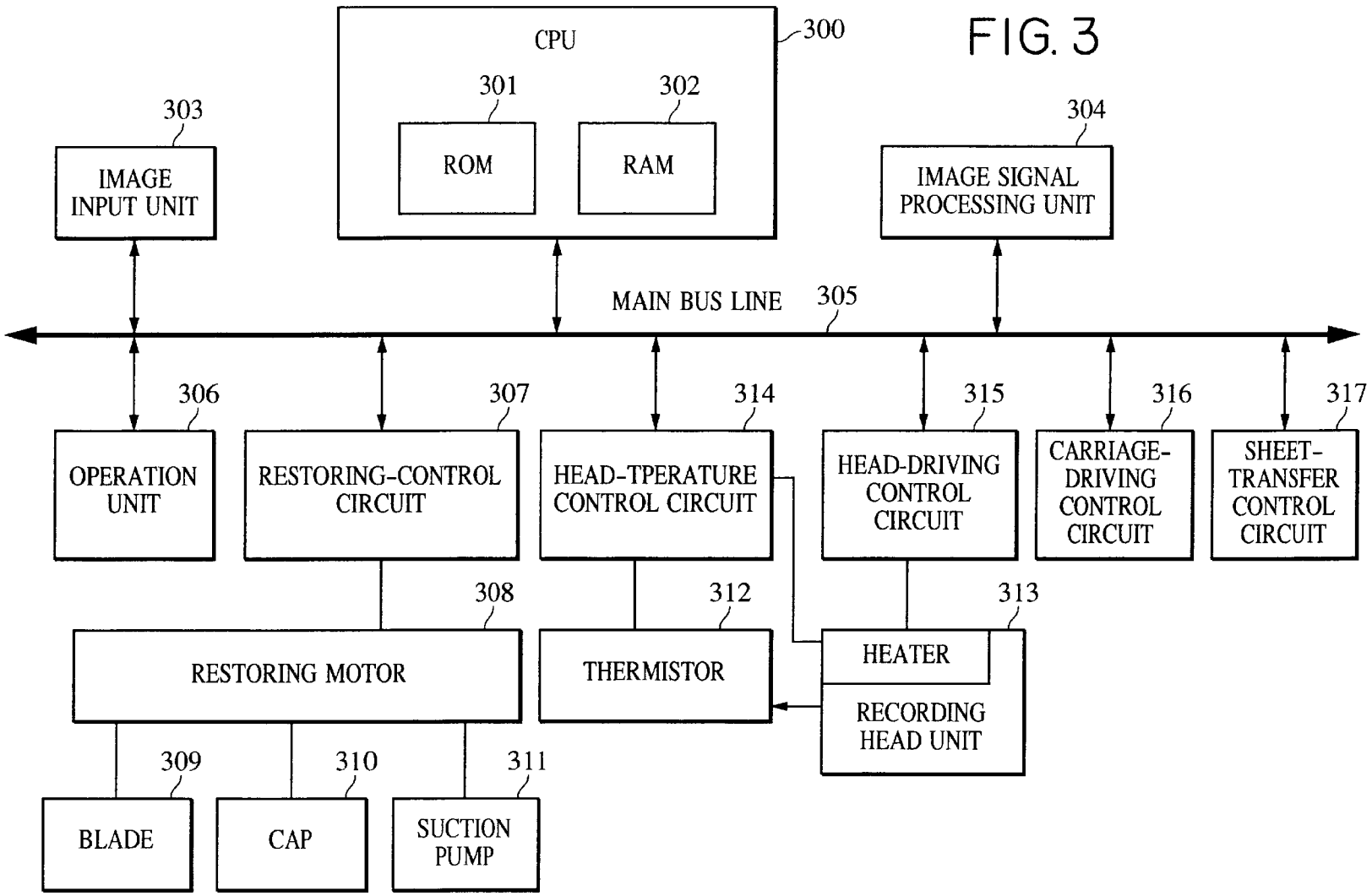
FIG. 3 is a block diagram of the configuration of control of the ink-jet recording apparatus according to the present invention.

FIG. 3 is a block diagram of the configuration of control of an ink-jet recording apparatus according to an embodiment of the present invention. The mechanical configuration of the ink-jet recording apparatus according to the embodiment is shown in FIG. 1.

FIG. 3 shows a software processing group including an image input unit 303, an image signal processing unit 304, and a CPU 300 as a central control unit, each having an access to a main bus line 305, and a hardware processing group including an operation unit 306, a restoring-control circuit 307, an ink-jet-head-temperature control circuit 314, a head-driving control circuit 315, a control circuit 316 for controlling driving of a carriage in a primary scanning direction, and a control circuit 317 for controlling transfer of paper sheets in a secondary scanning direction. The CPU 300 generally includes a ROM 301 and a random access memory (RAM) 302. The CPU 300 drives a recording head unit 313 by supplying thereto proper conditions in accordance with inputted data, thereby performing printing. The RAM 302 stores a program for performing a head-restoring-timing chart, and supplies restoring conditions, such as preliminary ejection conditions, to the restoring-control circuit 307, the recording head unit 313, a heater, and the like. A restoring motor 308 drives the recording head unit 313, and a cleaning blade 309, a cap 310, and a suction pump 311, each opposing the recording head unit 313 across a gap. The head-driving control circuit 315 performs a driving condition of a thermal transducer for ink ejection of the recording head unit 313. The head-driving control circuit 315 generally drives the recording head unit 313 to perform preliminary ejection and ink-ejection for recording.

A heater is provided on a substrate of the recording head unit 313 provided with a thermal transducer for ink-ejection, whereby the ink temperature in the recording head unit 313 can be controlled on a predetermined level. A thermistor 312 provided on the substrate serves for measuring the ink temperature in the recording head unit 313. The thermistor 312 may be provided outside the substrate, and it may be disposed in the vicinity of the recording head unit 313.

Embodiments of the ink-jet recording apparatus, according to the invention, having the configuration described above are described below.

(First Embodiment)

Figure 4:
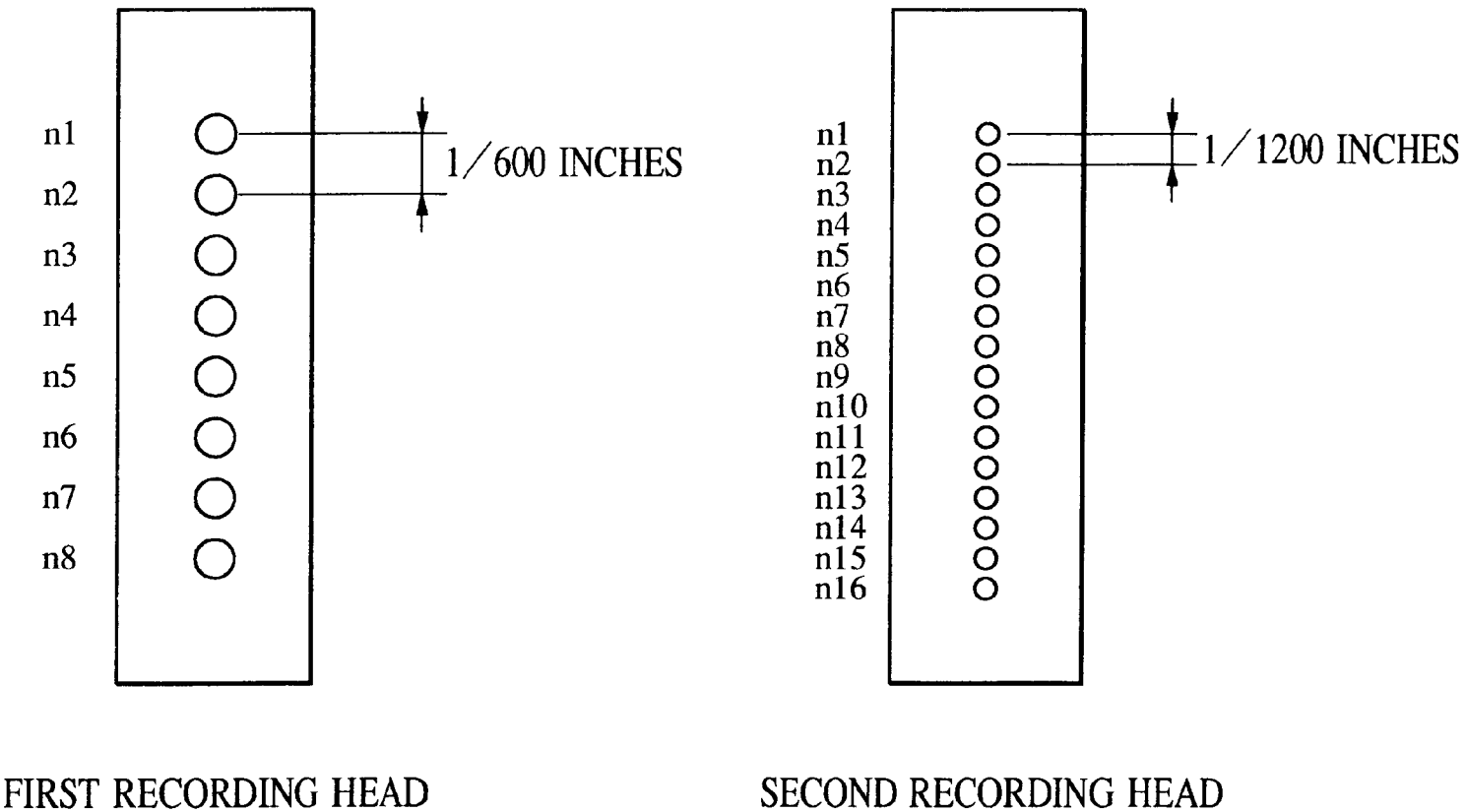
FIG. 4 is an illustration of a recording head unit according to the present invention.

FIG. 4 shows a recording head unit according to a first embodiment of the present invention. A first recording head shown in FIG. 4 includes n=8 nozzles disposed at a density of N=600 per inch (600 dpi). A second recording head shown in FIG. 4 includes n=16 nozzles disposed at a density of N=1200 per inch (1200 dpi) which is m=2 times the density of nozzles of the first recording head. The recording width of one scan of the second recording head is the same as that of the first recording head.

Figure 5:
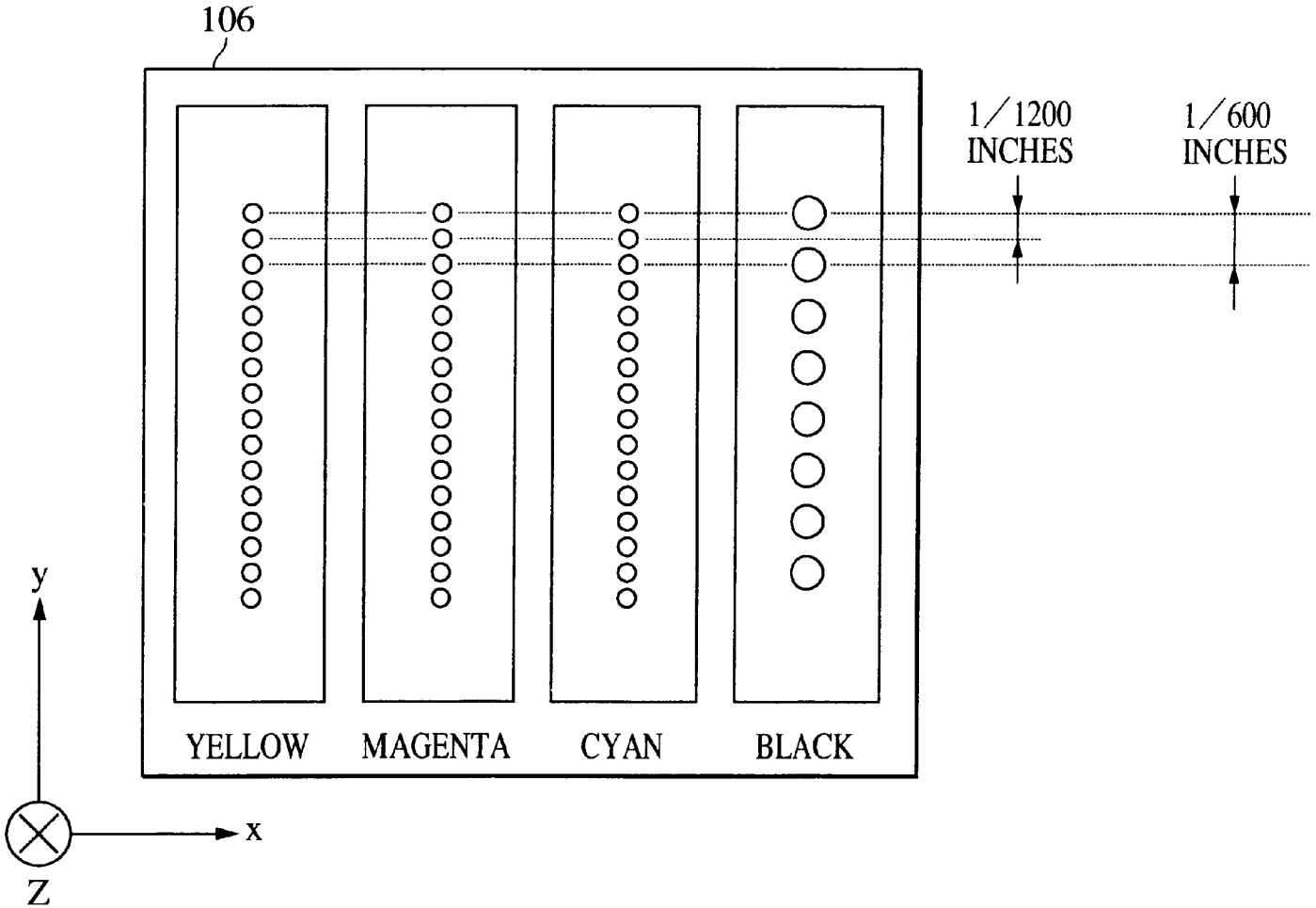
FIG. 5 is an illustration of an individual-type recording head unit according to the present invention.
Figure 6:
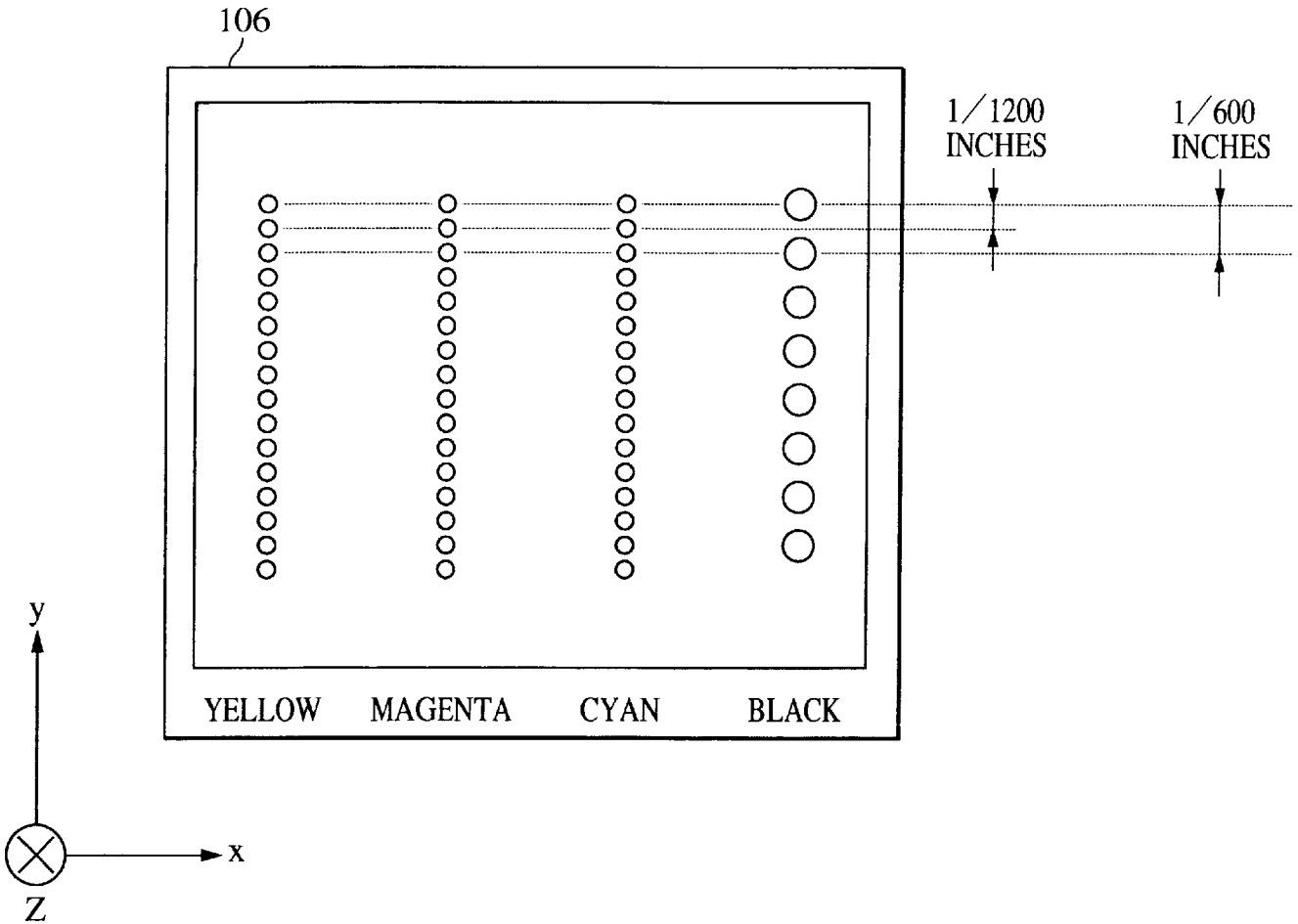
FIG. 6 is an illustration of an integrated-type recording head unit according to the present invention.

FIG. 5 is an illustration of a recording head unit in which the second recording head shown in FIG. 4 is used as each of the recording heads 101 for yellow, magenta, and cyan disposed on the carriage 106 shown in FIG. 1, and the first recording head shown in FIG. 4 is used as the recording head 101 for black shown in FIG. 1. FIG. 5 also shows the relationship of positions of the nozzles between each recording head. The nozzles of each second recording head shown in FIG. 5 are disposed in the secondary scanning direction (the Y-direction) at the same positions as of the nozzles of the other second recording heads, which are referred to by using the same nozzle numbers shown in FIG. 4. The nozzles of the first recording head shown in FIG. 5 are disposed in the Y-direction at the same positions as of the nozzles of the second recording heads, which are referred to by using odd nozzle-numbers n1, n3, . . . , n13, and n15 shown in FIG. 4. The four recording heads are disposed in the primary scanning direction (the X-direction) at a predetermined distance between each other. The second recording heads and the first recording head may be formed in an integral recording head unit, as shown in FIG. 6. The nozzles of the recording heads may be disposed in a staggered fashion, as shown by an individual-type head in FIG. 7A and an integrated-type head in FIG. 7B, instead of being disposed in lines. In this case, driving signals are supplied for preceding nozzles having even nozzle-numbers earlier than for succeeding nozzles having odd nozzle-numbers by d/v [second], in which d [inch] represents the distance between the nozzles having odd nozzle-numbers and the nozzles having even nozzle-numbers, and v [inch/second] represents the speed of the recording heads moving in the primary scanning direction (the X-direction).

Figure 8B:
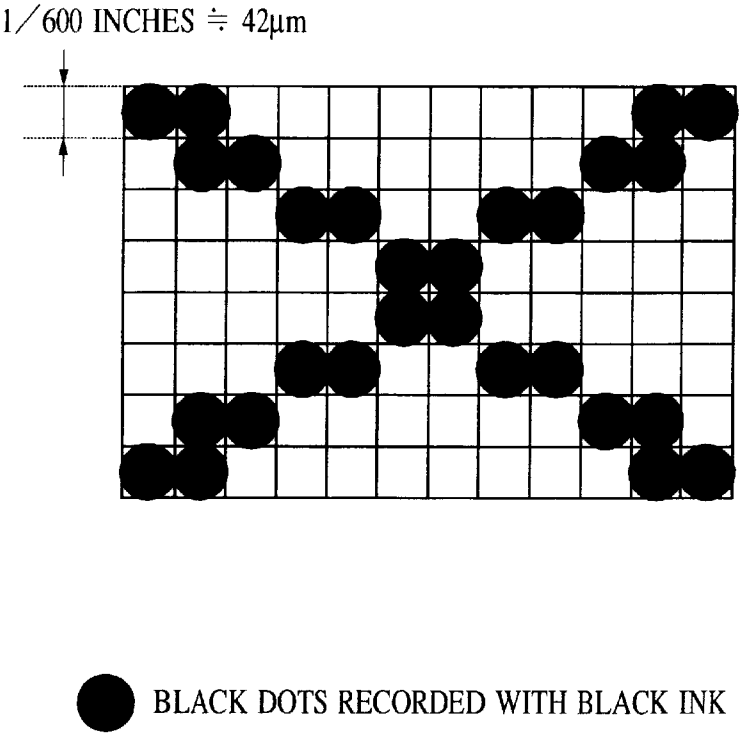
FIG. 8B is an illustration of black dots of black ink recorded by a first recording method according to the first embodiment of the present invention.
Figure 8A:
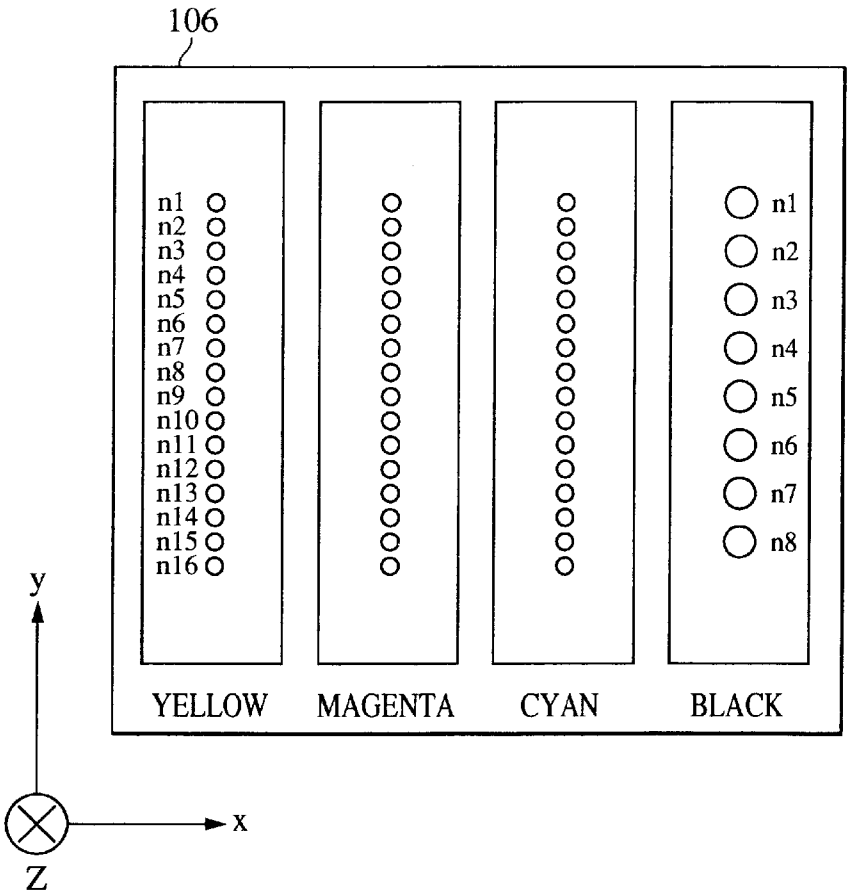
FIG. 8A is an illustration showing a first recording head unit according to a first embodiment of the present invention.

A first recording method (first recording mode) according to the first embodiment of the present invention is described with reference to FIGS. 8A and 8B. FIG. 8A shows a recording head unit according to the first embodiment. FIG. 8B shows dots formed by a first recording method, according to the first embodiment, by one scan in accordance with image data of the letter "x" in black with the resolutions 600×600 dpi in the primary and secondary scanning directions. In FIG. 8B, black circles formed with the dots ejected by the nozzles n1 to n8 of the first recording head shown in FIG. 8A are disposed at positions corresponding to the resolutions 600×600 dpi in the primary and secondary scanning directions.

Figure 9B:
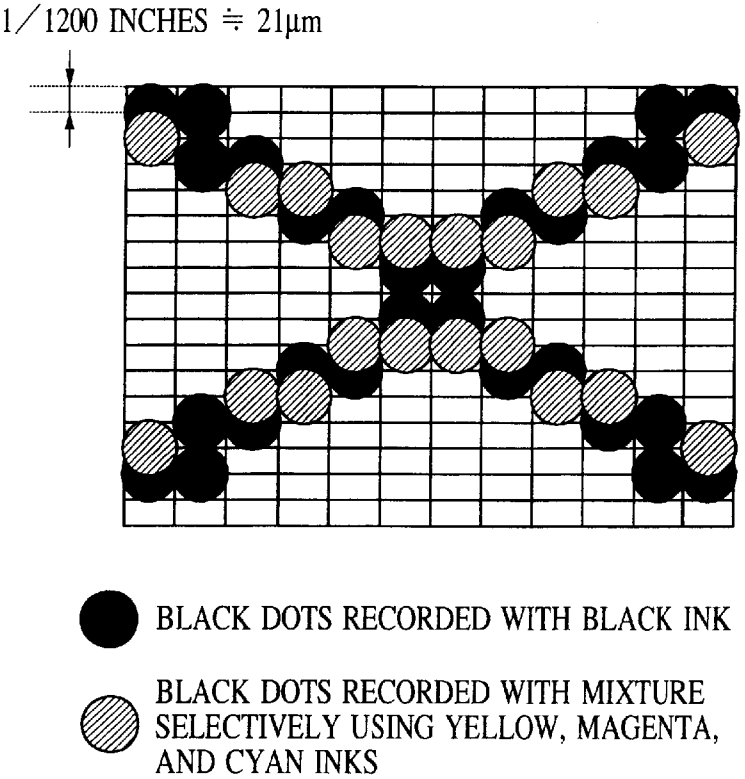
FIG. 9B is an illustration of black dots recorded by a second recording method according to the first embodiment of the present invention.
Figure 9A:
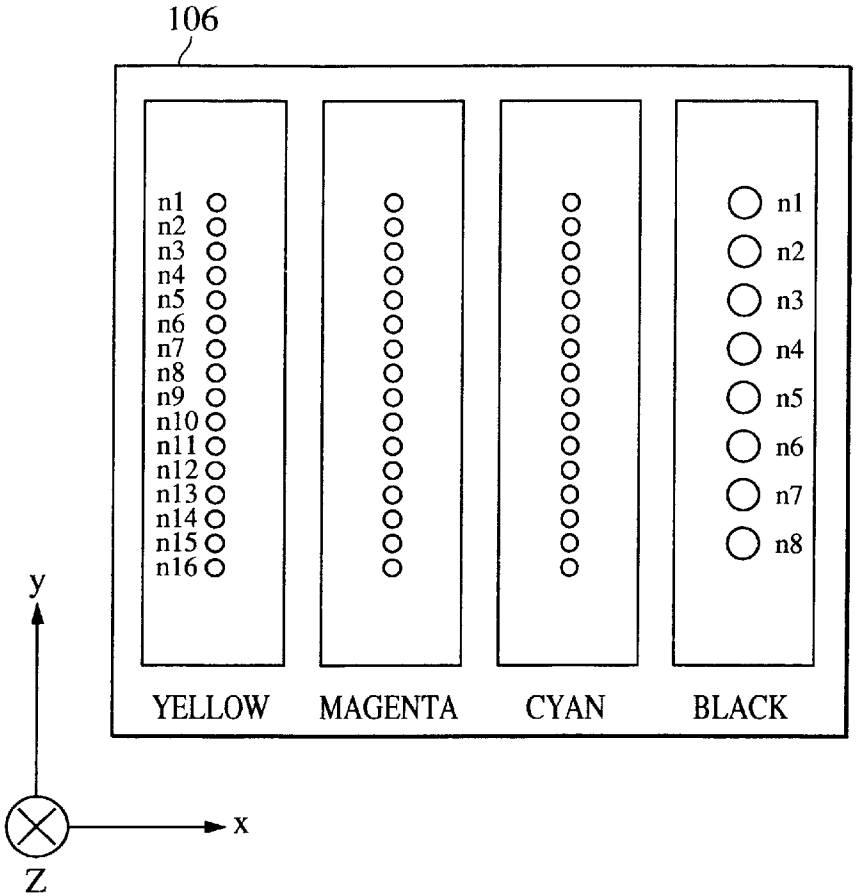
FIG. 9A is an illustration of a second recording head unit according to the first embodiment of the present invention.

A second recording method (second recording mode) according to the first embodiment is described with reference to FIGS. 9A and 9B. FIG. 9A shows the recording head unit shown in FIG. 8A. FIG. 9B shows dots formed by a second recording method, according to the first embodiment, by one scan in accordance with image data of the letter "x" in black with the resolutions 600 dpi in the primary scanning direction and 1200 dpi in the secondary scanning direction. In FIG. 9B, black circles formed with the dots ejected by the nozzles n1 to n8 of the first recording head are disposed at positions corresponding to the resolutions 600×600 dpi in the primary and secondary scanning directions. Circles with slanted lines formed with black dots of a mixture by selectively using cyan, magenta, and yellow (one color, two colors, or three colors) inks ejected by eight nozzles having even nozzle-numbers n2, n4, . . . , and n16 of each second recording head are disposed at positions corresponding to the resolution 600 dpi in the primary scanning direction and at positions corresponding to the resolution offset from the dots formed by the first recording head by 1200 dpi in the secondary scanning direction.

The resolution of recording in the secondary scanning direction can be improved, without increasing the number of movements in the primary direction, by recording by using the second recording method shown in FIGS. 9A and 9B rather than by using the first recording method shown in FIGS. 8A and 8B, thereby reducing jugged edges and dots of black characters and the like. When the resolutions of image data for black are 600×600 dpi in the primary and secondary scanning directions, the recording is performed by using the first recording method, and when the resolutions of image data for black are 600 dpi in the primary scanning direction and 1200 dpi in the secondary scanning direction, the recording is performed by using the second recording method, whereby optimum recording is possible in accordance with image data without reducing the recording speed.

Although according to the first embodiment, the density of the nozzles of the second recording heads is set to twice that of the first recording head, it may be three times the density of the nozzles of the first recording head or greater, and image data for black are recorded only with black ink formed by selectively mixing other color inks of the second recording heads. Although according to the first embodiment, the image data for black other than those which correspond to the positions of the nozzles of the first recording head are recorded with black ink formed by selectively mixing cyan, magenta, and yellow inks by using the three second-recording-heads, any combination of not less than two color-inks which can form the black color may be used.

(Second Embodiment)

According to the first embodiment, when the resolutions of image data are 600 dpi in the primary scanning direction and 1200 dpi in the secondary scanning direction, the image data for black, corresponding to the positions of nozzles disposed in the secondary scanning direction of the first recording head of which the density of the nozzles is 600 dpi in the secondary scanning direction, are recorded only by the first recording head ejecting black ink. In contrast, in a second embodiment, recording on the same positions is also performed in black by using a mixture of cyan, magenta, and yellow inks by second recording heads.

A first recording method (first recording mode) according to the second embodiment is the same as the first recording method which is described in the first embodiment.

Figure 10B:
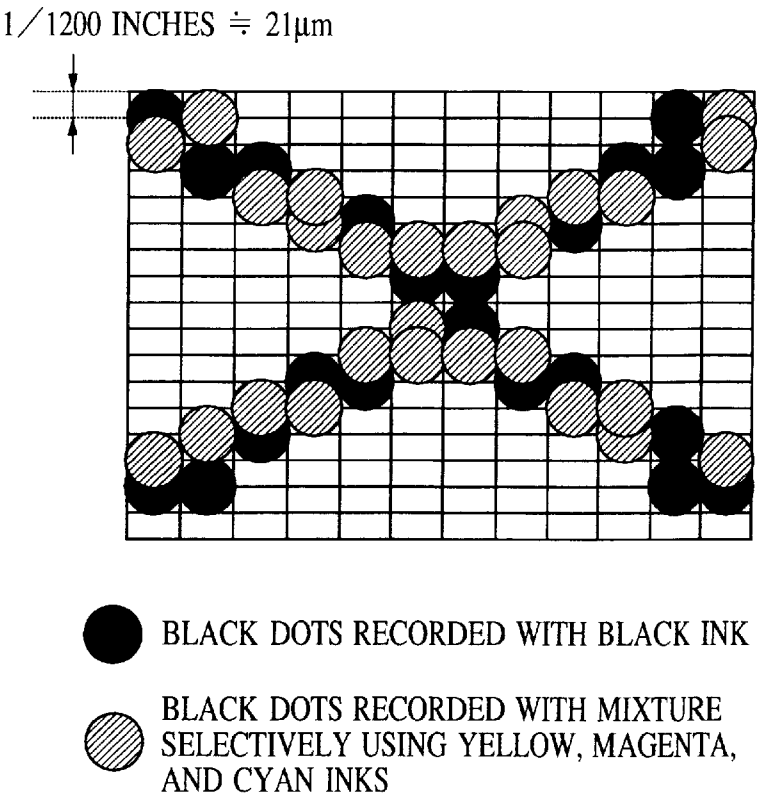
FIG. 10B is an illustration of black dots recorded by a second recording method according to the second embodiment of the present invention.
Figure 10A:
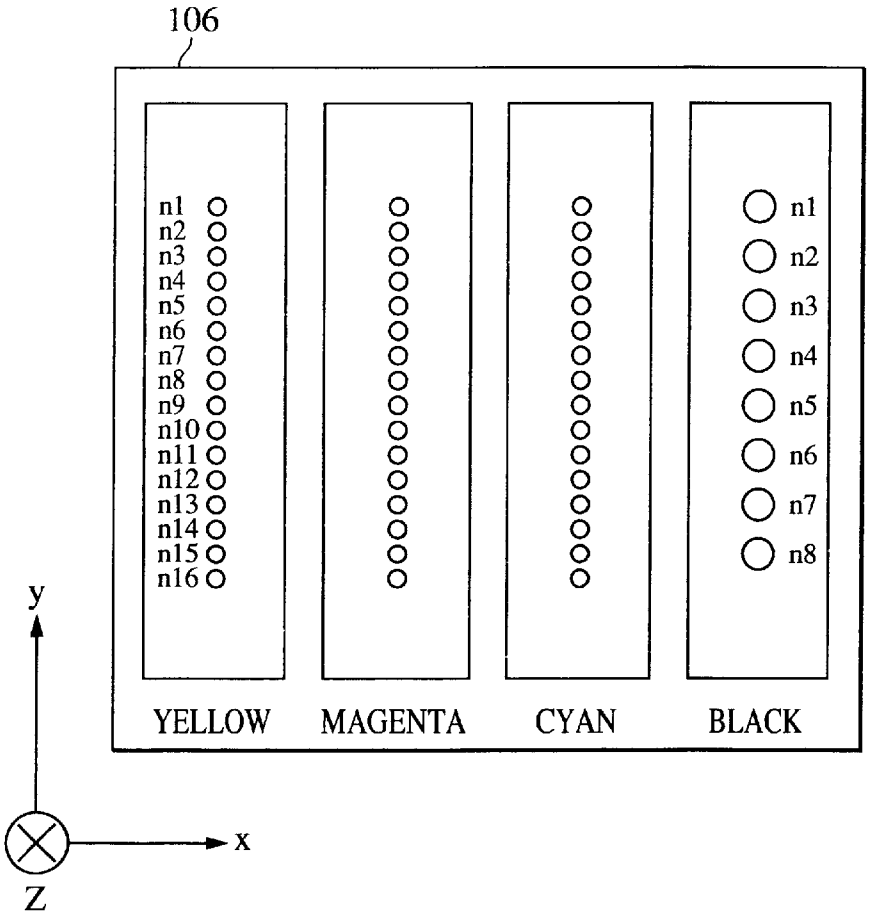
FIG. 10A is an illustration of a second recording head unit according to a second embodiment of the present invention.

A second recording method (second recording mode) is described below with reference to FIGS. 10A and 10B. FIG. 10A shows a recording head according to the second embodiment, which is the same as that which is used in the first embodiment. FIG. 10B shows the letter "x" of image data having resolutions of 600 dpi in the primary scanning direction and 1200 dpi in the secondary scanning direction, the letter "x" being recorded by the second recording method. In FIG. 10B, image data for black corresponding to the positions of nozzles of the first recording head for ejecting black ink disposed in the secondary scanning direction are recorded, as shown with black circles formed with black dots ejected by nozzles n1 to n8 and circles with slanted lines formed with black dots (dots formed with one color, two colors, or three colors) of black ink, formed by selectively mixing cyan, magenta, and yellow inks ejected by eight nozzles having odd nozzle-numbers n1, n3, . . . , and n15 of each of three second recording heads, disposed at positions corresponding to the resolutions 600×600 dpi in the primary and secondary scanning directions. Image data for black offset in the secondary scanning direction by resolution of 1200 dpi from the positions of the nozzles of the first recording head are recorded only with circles with slanted lines formed with black dots (dots formed with one color, two colors, or three colors) of black ink formed by selectively mixing cyan, magenta, and yellow inks ejected by eight nozzles having even nozzle-numbers n2, n4, . . . , and n16 of each of the three second recording heads, disposed at positions corresponding to the resolution 600 dpi in the primary scanning direction and positions corresponding to the resolution in the secondary scanning direction offset by 1200 dpi from the positions of the black dots ejected by the nozzles of the first recording head.

The resolution of recording in the secondary scanning direction can be improved, without increasing the number of movements in the primary direction, by recording by using the second recording method shown in FIGS. 10A and 10B rather than by using the first recording method shown in FIGS. 8A and 8B, thereby reducing jugged edges and dots of black characters and the like. When the resolutions of image data for black are 600×600 dpi in the primary and secondary scanning directions, the recording is performed by using the first recording method, and when the resolutions of image data for black are 600 dpi in the primary scanning direction and 1200 dpi in the secondary scanning direction, the recording is performed by using the second recording method, whereby optimum recording is possible in accordance with image data without reducing the recording speed.

Figure 7B:
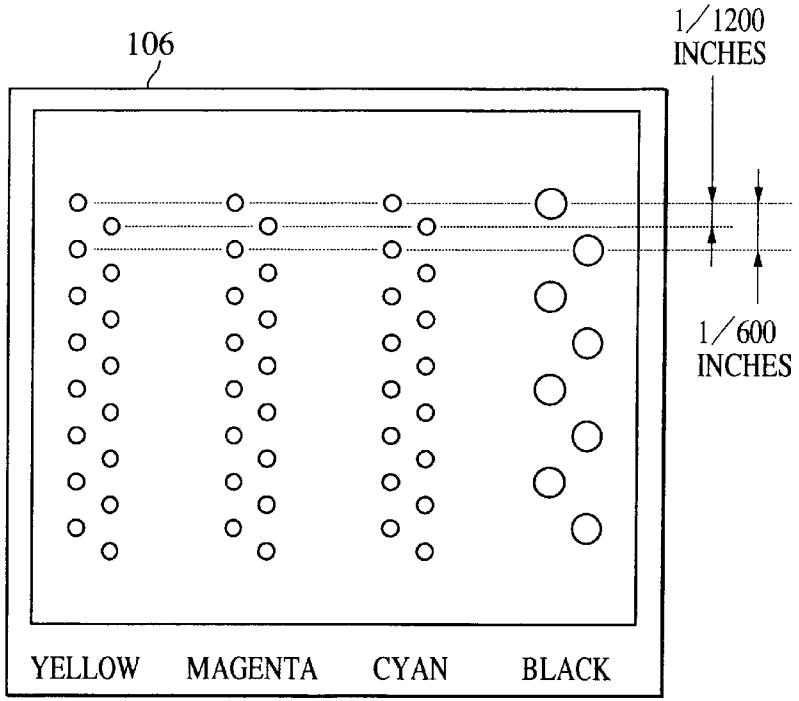
FIG. 7B is an illustration of an integrated-type recording head unit according to the present invention, having ink nozzles disposed in a staggered fashion.
Figure 7A:
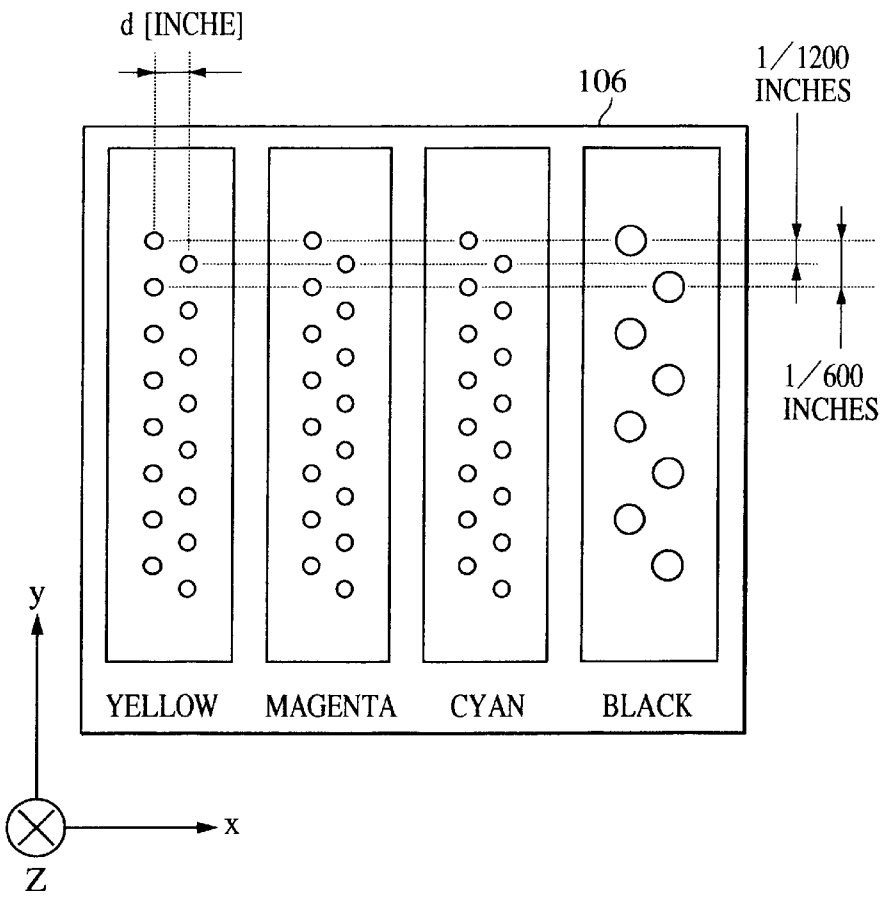
FIG. 7A is an illustration of an individual-type recording head unit according to the present invention, having ink nozzles disposed in a staggered fashion.

Although according to the second embodiment, the nozzles of each recording head disposed in line in the secondary scanning direction at a predetermined distance from each other, the nozzles may be disposed in a staggered fashion in each recording head, as shown in FIG. 7A. The recording heads may be formed in an integrated manner, as shown in FIGS. 6 and 7B. Although according to the second embodiment, the density of the nozzles of each second recording head is twice that of the nozzles of the first recording head, it may be three time that of the nozzles of the first recording head or greater, and image data for black may be recorded only with black ink formed by selectively mixing other color inks of the second recording heads. Although according to the first embodiment, the image data for black other than those which correspond to the positions of the nozzles of the first recording head are recorded with black ink formed by selectively mixing cyan, magenta, and yellow inks by using the three second-recording-heads, any combination of not less than two color-inks which can form black may be used.

(Third Embodiment)

Although according to the first and second embodiments, the first recording head ejects black ink of a predetermined fixed amount sufficient to fill a mesh of a lattice formed in the resolutions 600×600 dpi in the primary and secondary directions, the amount of black ink to be ejected is variable, according to a third embodiment.

A first recording method (first recording mode) according to the third embodiment is the same as the first recording method which is described in the first embodiment of the present invention.

Figure 11B:
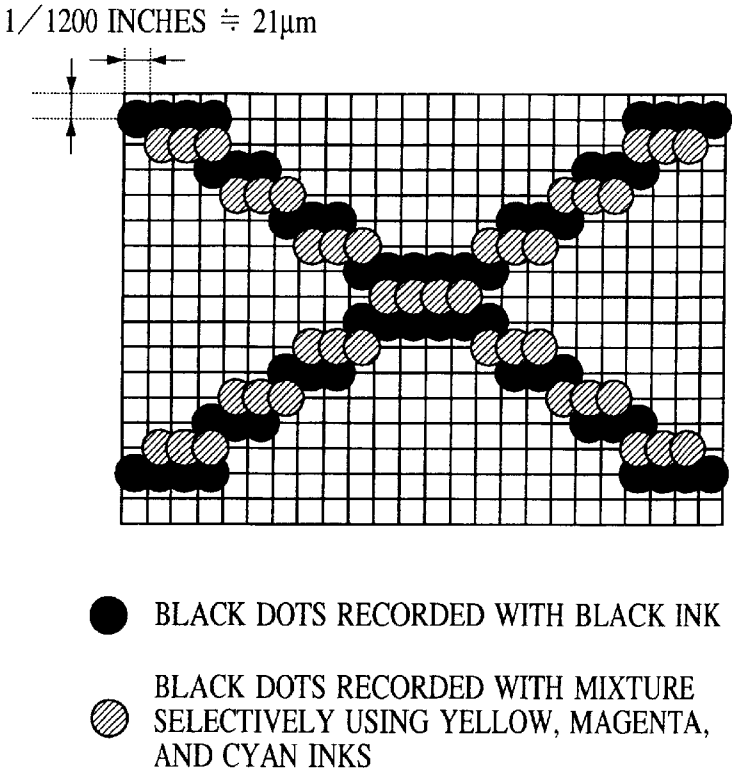
FIG. 11B is an illustration of black dots recorded by a second recording method according to the third embodiment of the present invention.
Figure 11A:
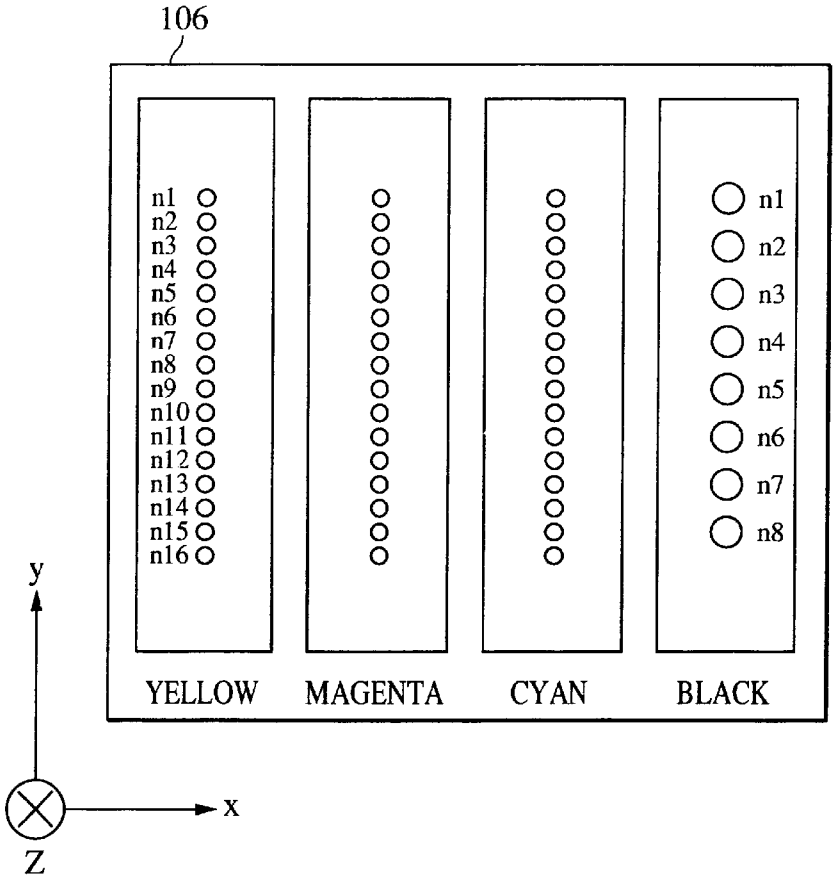
FIG. 11A is an illustration of a second recording head unit according to a third embodiment of the present invention.

A second recording method (first recording mode) according to the third embodiment is described with reference to FIGS. 11A and 11B. FIG. 11A shows recording heads used in the third embodiment, of which the amount of ejection is variable, the configuration being the same as those used in the first and second embodiments. FIG. 11B shows the letter "x" of image data having resolutions of 1200×1200 dpi in the primary and secondary scanning directions, the letter "x" being recorded in one scan by the second recording method. In FIG. 11B, image data for black corresponding to the positions of nozzles of the first recording head for ejecting black ink disposed in the secondary scan direction are recorded with black circles formed with black dots of a size sufficient to fill a mesh of a lattice formed in the resolutions 1200×1200 dpi ejected by nozzles n1 to n8 of the first recording head, the black dots being disposed at positions corresponding to the resolutions 1200 dpi in the primary scanning direction and 600 dpi in the secondary scanning direction. Image data for black offset in the secondary scanning direction by the resolution 1200 dpi from the nozzles for black ink of the first recording head are recorded only with circles with slanted lines formed with black dots of black ink of an amount sufficient to fill a lattice formed in the resolutions 1200×1200 dpi in the primary and secondary scanning directions, the black ink being formed by selectively mixing cyan, magenta, and yellow inks (one color, two colors, or three colors) ejected by eight nozzles having even nozzle-numbers n2, n4, , and n16 of each of three second recording heads, the black dots being disposed at positions corresponding to the resolution 1200 dpi in the primary scanning direction and positions offset by the resolution 1200 dpi in the secondary scanning direction from the back circles of the dots ejected by the first recording head.

FIGS. 13, 14A, 14B, 14C, 15A, and 15B are illustrations showing the disposition of thermal transducers (hereinafter referred to as heaters) in ink-jet heads according to the third embodiment.

Figure 13:
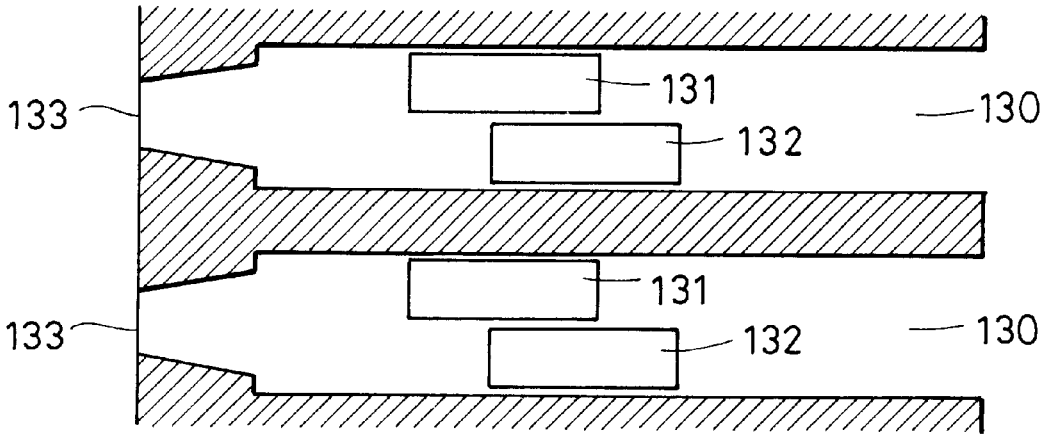
FIG. 13 is an illustration of heaters (electrical thermal-transducers) disposed in nozzles of an ink-jet recording head according to the fourth embodiment.

In FIG. 13, heaters 131 and 132 are disposed overlapping each other in a vertical direction in each ink path 130 so as to be offset from each other in a horizontal direction. The amount of ink to be ejected (the diameter of a dot) differs between a case in which only the heater 131, which is disposed toward a nozzle 133 from the heater 132, is driven to heat, and another case in which the heaters 131 and 132 are driven to heat at the same time.

Figure 14A:
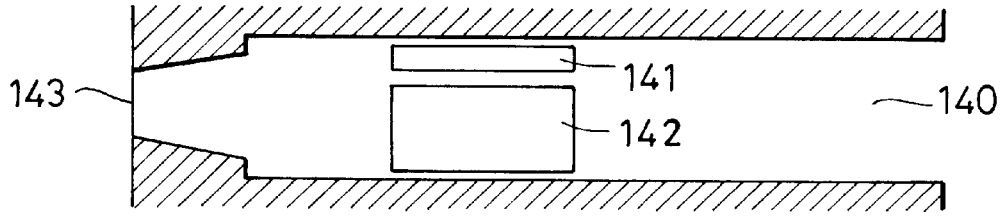
FIGS. 14A, 14B, and 14C are illustrations of the heaters (electrical thermal-transducers) disposed in the nozzle of the ink-jet recording head according to the fourth embodiment.
Figure 14B:
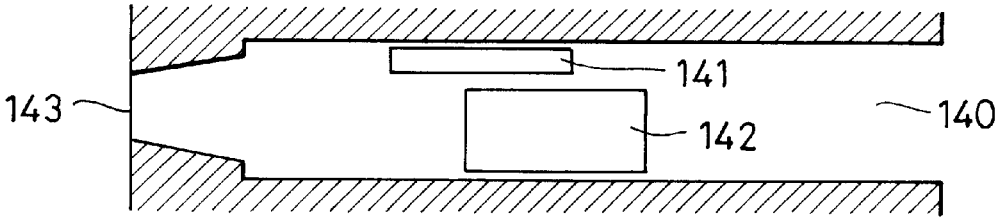
Figure 14C:
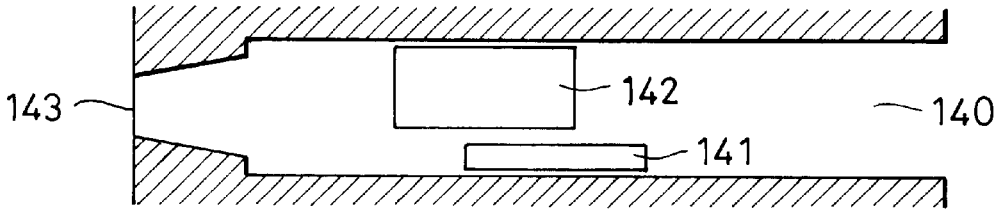

In FIGS. 14A to 14C, a smaller heater 141 and a larger heater 142 are disposed in each ink path 140, the heating value of the larger heater 142 being greater than that of the smaller heater 141. The larger and smaller heaters 141 and 142 are disposed at positions in ink path 140 differing between FIGS. 14A to 14C. An ink droplet of a size corresponding to a smaller dot, an intermediate dot, or a larger dot can be ejected by a nozzle 143 by only driving the smaller heater 141 or the larger heater 142 or by simultaneously driving the smaller and larger heaters 141 and 142.

Figure 15A:
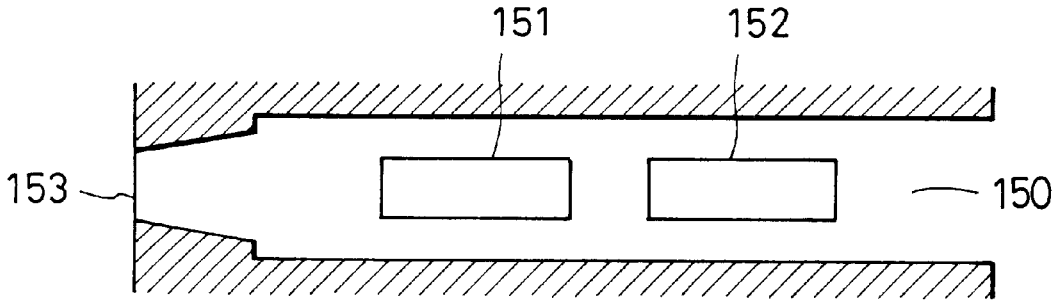
FIGS. 15A and 15B are illustrations of the heaters (electrical thermal-transducers) disposed in the nozzle of the ink-jet recording head according to the fourth embodiment.
Figure 15B:
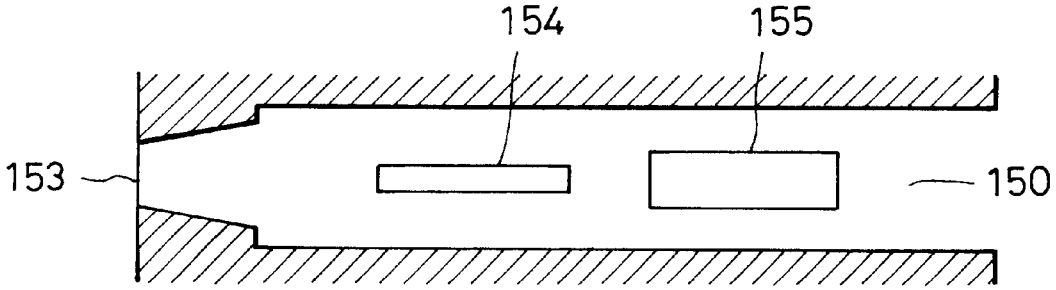

In FIG. 15A, heaters 151 and 152 having substantially the same heating values are disposed in a horizontal direction. The amount of ink to be ejected is variable in two ways by only driving the heater 151 or simultaneously driving the heaters 151 and 152. In FIG. 15B, a smaller heater 154 and a larger heater 155 having different heating values from each other are disposed in a horizontal direction, the smaller heater 154 being disposed toward a nozzle 153 from the larger heater 155. The amount of ink to be ejected is variable in three ways by only driving the smaller heater 154 or the larger heater 155 or simultaneously driving the smaller and larger heaters 154 and 155.

By using the recording heads variable in the amount of ink ejection, recording can be performed by the first recording method, as shown in FIGS. 8A and 8B, when the resolutions of image data are 600×600 dpi in the primary and secondary scanning directions and by the second recording method, as shown in FIGS. 11A and 11B, when the resolutions of image data are 1200×1200 dpi in the primary and secondary directions, in which jugged edges and dots of black characters and the like can be reduced. The resolutions of recording in the primary and secondary scanning directions can be improved by the same number of movements of the recording heads in the primary scanning direction in the first recording method as in the second recording method, whereby optimum recording is possible in accordance with image data without reducing the recording speed.

Although according to the third embodiment, the nozzles of each recording head are disposed in line in the secondary scanning direction at a predetermine distance from each other, the nozzles may be disposed in a staggered fashion in each recording head, as shown in FIG. 7A. The recording heads may be formed in an integrated manner, as shown in FIGS. 6 and 7B. Although according to the third embodiment, the density of the nozzles of each second recording head is twice that of the nozzles of the first recording head, it may be three time that of the nozzles of the first recording head or greater, and image data for black may be recorded only with black ink formed by selectively mixing other color inks of the second recording heads. Although the image data for black other than those which correspond to the positions of the nozzles of the first recording head are recorded with black ink formed by selectively mixing cyan, magenta, and yellow inks by using the three second-recording-heads, any combination of not less than two color-inks which can form black may be used. The image data for black corresponding to the positions of the nozzles of the first recording head may be recorded by the first and second recording heads in the same manner as in the second embodiment.

(Fourth Embodiment)

Although according to the third embodiment, each black dot in accordance with the resolution of the image data for black is graded in two levels, multi-level gradation according to a fourth embodiment is described below.

First and second recording heads used in the fourth embodiment are the same as those used in the third embodiment, in which the amount of ink ejection is variable.

Figure 12A:
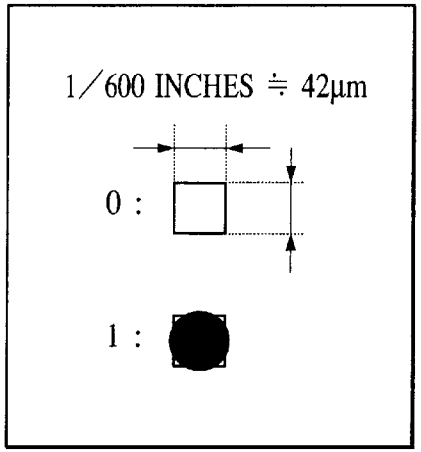
FIG. 12A is an illustration of a pixel pattern formed by a first recording method according to a fourth embodiment of the present invention.

When the image data for black have resolutions of 600×600 dpi in the primary and secondary scanning directions and each black dot in accordance with the resolutions is to be graded in two levels, the black dot is formed only by black ink ejected by the first recording head, the amount of the black ink being sufficient to fill a mesh of a lattice formed in accordance with the resolutions 600×600 dpi in the primary and secondary scanning directions. Pixel patterns formed in this case are shown in FIG. 12A.

Figure 12B:
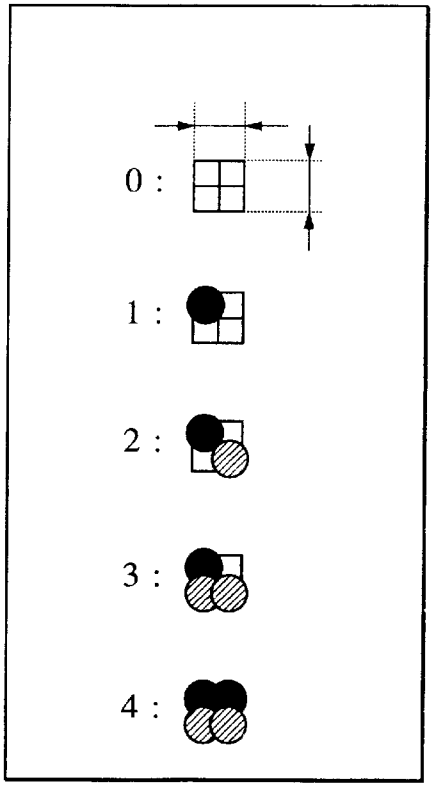
FIG. 12B is an illustration of pixel patterns formed by a second recording method according to the fourth embodiment of the present invention.

When the image data for black have resolutions of 600×600 dpi in the primary and secondary scanning directions and each black dot in accordance with the resolutions is to be graded in five levels, pixel patterns are formed with black dots of black ink ejected by the first recording head, the amount of the black ink being sufficient to fill the corresponding meshes of a lattice formed in accordance with the resolutions 1200×1200 dpi in the primary and secondary scanning directions, and other black dots of black ink formed by selectively mixing cyan, magenta, and yellow inks (one color, two colors, or three colors) ejected by eight nozzles having even nozzle-numbers n2, n4, . . . , and n16 of each of three second recording heads for ejecting cyan, magenta, and yellow inks, respectively, the amount of the black ink being sufficient to fill the corresponding meshes of a lattice formed in accordance with the resolutions 1200×1200 dpi in the primary and secondary scanning directions. Pixel patterns in five levels of gradation are shown in FIG. 12B. Each pixel pattern in one of five levels to 4 of gradation shown in FIG. 12B is formed by a combination of a nozzle of the first recording head and nozzles of the second recording heads, the combination being made in a manner such that the nozzle-number of the nozzles of the second recording heads is twice the nozzle-number of the nozzle of the first recording head, for example, nozzle n1 of the first recording head and nozzles n2 of the second recording head, nozzle n2 of the first recording head and nozzles n4 of the second recording heads, nozzle n8 of the first recording head and nozzles n16 of the second recording heads, etc.

A photograph-like high-quality color-image can be recorded, in which the gradation of black is increased by using the recording heads and the amount of ink ejection is variable, by using the first recording method when the image data for black has resolutions of 600×600 dpi in the primary and secondary scanning directions and two levels in gradation, and by using the second recording method when the image data for black has resolutions of 600×600 dpi in the primary and secondary scanning directions and five levels in gradation. The resolutions of recording in the primary and secondary scanning directions can be improved by the same number of movements of the recording heads in the primary scanning direction in the first recording method as in the second recording method, whereby optimum recording is possible in accordance with image data without reducing the recording speed.

Although according to the fourth embodiment, the nozzles of each recording head disposed in line in the secondary scanning direction at a predetermine distance from each other, the nozzles may be disposed in a staggered fashion in each recording head, as shown in FIG. 7A. The recording heads may be formed in an integrated manner, as shown in FIGS. 6 and 7B. Although according to the fourth embodiment, the density of the nozzles of each second recording head is twice that of the nozzles of the first recording head, it may be three time that of the nozzles of the first recording head or greater, and the image data for black may be recorded only with black ink formed by selectively mixing other color inks of the second recording heads. Although the image data for black other than those which correspond to the positions of the nozzles of the first recording head are recorded with black ink formed by selectively mixing cyan, magenta, and yellow inks by using the three second-recording-heads, any combination of not less than two color-inks which can form black may be used. The image data for black corresponding to the positions of the nozzles of the first recording head may be recorded by the first and second recording heads in the same manner as in the second embodiment.

Superior effects, according to the present invention, can be expected particularly in ink-jet-type recording heads and apparatuses in which recording is performed with soaring liquid droplets formed by using thermal energy.

The typical configuration and the principle are disclosed in, for example, U.S. Pat. Nos. 4,723,129 and 4,740,796. The method can be applied to on-demand-types and continuous types. The method is effective particularly for the on-demand-type, in which at least one driving signal in accordance with recording data for driving to produce quick temperature-rise exceeding nuclear boiling point is given to an electrical thermal-transducer associated with a sheet or a liquid path containing liquid (ink) so that the electrical thermal-transducer generates thermal energy for generating film boiling on a thermally-acted surface of a recording head, thereby forming a bubble in the liquid (ink) in response to the driving signal. The liquid (ink) is ejected through a nozzle by expansion and contraction of the bubble so as to form at least one droplet of the liquid (ink). The driving signal is preferably formed in pulses so that the bubble is expanded and contracted quickly in an appropriate manner, whereby the liquid (ink) can be ejected in an excellent response.

Driving signals in pulses disclosed in, for example, U.S. Pat. Nos. 4,463,359 and 4,345,262 are suitable. Superior recording may be performed by applying the conditions concerning the rate of temperature rise on the thermally-acted surface, disclosed in, for example, U.S. Pat. No. 4,313,124.

Concerning the configuration of the recording heads, A configuration, in which the thermally-acted surface is disposed in a bent portion, disclosed in, for example, U.S. Pat. Nos. 4,558,333 and 4,459,600, may be used other than the configuration of the nozzles, liquid paths, and electrical thermal-transducers disclosed in the U.S. patents described above, in which a linear liquid path and right-angled liquid path are included.

The configurations disclosed in Japanese Patent Laid-Open Nos. 59-123670 and 59-138461 may be used, in which a slit is used as a nozzle associated with a plurality of electrical thermal-transducer, and openings which absorb pressure waves of thermal energy are associated with nozzles, respectively.

A chip-type recording head, which is detachably mounted on a recording apparatus so that the recording head is electrically connected to the recording apparatus and can be supplied with ink therefrom, may be used. Also, a cartridge-type recording head provided with an ink tank formed integrally therewith may be used.

The recording apparatus according to the present invention is preferably provided with a restoring unit for restoring the recording heads, an auxiliary unit, and the like. These are, for example, a cap unit, cleaning unit, compressing and suction units, an electrical thermal-transducer, another heating device, and an auxiliary heating unit which is a combination of an electrical thermal-transducer and a heating device. An auxiliary ejecting mode, in which ejection for a purpose other than recording is performed, may be provided for performing stable recording.

Liquid ink is used in the embodiments of the present invention. However, any ink which comes into a liquid state when receiving a recording signal may be used, such as an ink being soft or in a liquid state at a room temperature. The ink-jet-type recording apparatus according to the present invention is generally controlled so that the viscosity of the ink is in a range of stable ejection by controlling the temperature in the ink in a range between 30° C. and 70° C.

Temperature rise due to thermal energy may be avoided by using the thermal energy for converting a solid ink into a liquid ink, or an ink which is solid under natural conditions may be used for avoiding evaporation of the ink. Therefore, an ink which comes into a liquid state by the thermal energy is preferably used, the ink coming into a liquid state in response to a recording signal formed with the thermal energy for the ejection, or starting to get solid when it reaches a medium. In these cases, the ink may be held in a liquid state or solid state in recesses or pores of a porous sheet so as to oppose an electrical thermal-transducer. According to the present invention, the ink is most effectively used in the above-described film-boiling system.

According to the present invention, a recording apparatus is made possible, in which a black image, in particular, having high resolutions and a multi-level gradation can be recorded without reducing recording speed.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink-jet recording apparatus for performing recording by ejecting ink onto a recording medium while moving a recording head relative to the recording medium in a scanning direction, comprising:

a first nozzle unit including a plurality of nozzles for ejecting black ink disposed in line in a direction different from the scanning direction;

a second nozzle unit including a plurality of nozzles for ejecting colored inks disposed in line in a direction different from the scanning direction and at a density higher than a density of the nozzles included in the first nozzle unit, the plurality of nozzles for ejecting colored inks being capable of forming black ink by mixing colored inks; and means for recording a black image with black dots of the black ink ejected by the first nozzle unit and a mixture of dots of the color inks ejected by the second nozzle unit, the black dots being formed with a predetermined resolution in a secondary scanning direction different from the scanning direction and the mixture dots being formed in a region between the black dots formed with a predetermined resolution in the secondary scanning direction, such that the black image is recorded with a resolution higher than a resolution of the black image when recorded only by the first nozzle unit.

2. An ink-jet recording apparatus according to claim 1, wherein colored inks capable of forming a black ink with a mixture thereof comprise cyan, magenta, and yellow inks, and wherein the black ink is formed by selectively mixing the cyan, magenta, and yellow inks.

3. An ink-jet recording apparatus according to claim 1, wherein the size of an ink droplet ejected by the first nozzle unit differs from the size of an ink droplet ejected by the second nozzle unit.

4. An ink-jet recording apparatus according to claim 3, wherein, in the second recording mode, the sum of the size of each droplet in one ejection of colored inks selected to be mixed so as to form black ink equals the size of an ink droplet ejected by the first nozzle unit.

5. An ink-jet recording apparatus according to claim 1, wherein the recording head includes a thermal-energy-generating unit for generating thermal energy to be used for ejection.

6. An ink-jet recording apparatus for performing recording by ejecting ink onto a recording medium while moving a recording head relative to the recording medium in a scanning direction, comprising:

a first nozzle unit including a plurality of nozzles for ejecting black ink disposed in line in a direction different from the scanning direction;

a second nozzle unit including a plurality of nozzles for ejecting colored inks disposed in line in a direction different from the scanning direction and at a density higher than a density of the nozzles included in the first nozzle unit, the plurality of nozzles for ejecting colored inks being capable of forming black ink by mixing colored inks; and means for selectively recording in one of a first recording mode, in which a black image is recorded with black dots of the black ink ejected by the first nozzle unit, and a second recording mode, in which the first nozzle unit records the black image and the second nozzle unit records with a mixture of dots of the color inks ejected by the second nozzle unit, the black dots being formed with a predetermined resolution in a secondary scanning direction different from the scanning direction and the mixture dots being formed in a region between the black dots formed with a predetermined resolution in the secondary scanning direction, such that the black image is recorded with a resolution higher than a resolution of the black image when recorded only by the first nozzle unit.

7. An ink-jet recording apparatus according to claim 6, wherein one of the first recording mode and the second recording mode is selected in accordance with a resolution of the black image to be recorded.

8. An ink-jet recording apparatus according to claim 7, wherein recording is performed in the first recording mode when the first nozzle unit conforms with a first resolution of the black image to be recorded and in the second recording mode when the second nozzle unit conforms with a second resolution of the black image to be recorded.

9. An ink-jet recording apparatus according to claim 6, wherein one of the first recording mode and the second recording mode is selected in accordance with maximum levels of gradation of pixels of the black image to be recorded.

10. An ink-jet recording apparatus according to claim 9, wherein maximum levels of graduation of pixels of the black image to be recorded in the first recording mode are less than the maximum levels of gradation of pixels of the black image to be recorded in the second recording mode.

11. An ink-jet recording apparatus according to claim 6, wherein, in the second recording mode, the size of an ink droplet ejected by the first nozzle unit is greater than the size of an ink droplet ejected by the second nozzle unit.

12. An ink-jet recording apparatus according to claim 11, wherein, in the second recording mode, the size of a droplet of each colored ink selected to be mixed so as to form black ink and ejection by the second nozzle unit varies depending on the number of selected colored inks.

13. An ink-jet recording apparatus for performing recording by ejecting ink onto a recording medium while moving a recording head relative to the recording medium in a scanning direction, comprising:

a first nozzle including a plurality of nozzles for ejecting black ink disposed in line in a direction different from the scanning direction;

a second nozzle unit including a plurality of nozzles for ejecting colored inks disposed in line in a direction different from the scanning direction and at a density higher than a density of the nozzles included in the first nozzle unit, the plurality of nozzles for ejecting colored inks-being capable of forming black ink by mixing colored inks; and means for recording a black image with black dots of the black ink ejected by the first nozzle unit and a mixture of dots of the color inks ejected by the second nozzle unit, the black dots being formed with a predetermined resolution in a secondary scanning direction different from the scanning direction and the mixture dots being formed in a region between the black dots formed with a predetermined resolution in the secondary scanning direction, such that the black image is recorded with a resolution higher than a resolution of the black image when recorded only by the first nozzle unit.

14. An ink-jet recording apparatus for performing recording by ejecting ink onto a recording medium while moving a recording head relative to the recording medium in a scanning direction, comprising:

a first nozzle unit including a plurality of nozzles for ejecting black ink disposed in line in a direction different from the scanning direction;

a second nozzle unit including a plurality of nozzles for ejecting colored inks disposed in line in a direction different from the scanning direction and at a density higher than a density of the nozzles included in the first nozzle unit, the plurality of nozzles for ejecting colored inks being capable of forming black ink by mixing colored inks; and means for selectively recording in one of a first recording mode in which a black image is recorded with black dots of the black ink ejected by the first nozzle unit and a second recording mode in which the first nozzle units records the black image and the second nozzle unit records with a mixture of dots of the color inks ejected by the second nozzle unit, the black dots being formed with a predetermined resolution in a secondary scanning direction different from the scanning direction and the mixture dots being formed in a region between the black dots formed with a predetermined resolution in the secondary scanning direction, such that the black image is recorded with a resolution higher than a resolution of the black image when recorded only by the first nozzle unit.

15. An ink-jet recording method for performing recording by ejecting ink onto a recording medium while moving a recording head relative to the recording medium in a scanning direction, using a first nozzle unit including a plurality of nozzles for ejecting black ink disposed in line in a direction different from the scanning direction, and a second nozzle unit including a plurality of nozzles for ejecting colored inks disposed in line in a direction different from the scanning direction and at a density higher than a density of the nozzles included in the first nozzle unit, the plurality of nozzles for ejecting colored inks being capable of forming black ink by mixing colored inks, said method comprising the step of:

recording a black image with black dots of the black ink ejected by the first nozzle unit and a mixture of dots of the color inks ejected by the second nozzle unit, the black dots being formed with a predetermined resolution in a secondary scanning direction different from the scanning direction and the mixture dots being formed in a region between the black dots formed with a predetermined resolution in the secondary scanning direction, such that the black image is recorded with a resolution higher than a resolution of the black image when recorded only by the first nozzle unit.

16. An ink-jet recording method according to claim 15, wherein the recording head includes a thermal-energy-generating unit for generating thermal energy to be used for ejection.

* * * * *

UNITED STATES PATENT AND TRADEMARK OFFICE

CERTIFICATE OF CORRECTION

PATENT NO. : 6,471,322 B2
APPLICATION NO. : 09/735807
DATED : October 29, 2002
INVENTOR(S) : Hidehiko Kanda et al.

It is certified that error appears in the above-identified patent and that said Letters Patent is hereby corrected as shown below:

COLUMN 1

Line 36, “FIGS. 1” should read --FIG. 1--.

COLUMN 2

Line 27, “twice of” should read --twice to--.

COLUMN 7

Line 4, “jugged” should read --jagged--.

COLUMN 8

Line 14, “jugged” should read --jagged--.

COLUMN 9

Line 17, “n4, , and” should read --n4, ..., and--; and
Line 64, “jugged” should read --jagged--.

COLUMN 10

Line 7, “predetermine” should read --predetermined--;
Line 14, “time” should read --times--; and
Line 63, “to 4” should read --0 to 4--.

COLUMN 11

Line 24, “predetermine” should read --predetermined--; and
Line 31, “time” should read --times--.

COLUMN 12

Line 7, “A” should read --a--; and
Line 18, “thermal-transducer,” should read --thermal-transducers,--.

COLUMN 13

Line 67, “the first nozzle unit” should be deleted.

UNITED STATES PATENT AND TRADEMARK OFFICE

CERTIFICATE OF CORRECTION

PATENT NO. : 6,471,322 B2
APPLICATION NO. : 09/735807
DATED : October 29, 2002
INVENTOR(S) : Hidehiko Kanda et al.

It is certified that error appears in the above-identified patent and that said Letters Patent is hereby corrected as shown below:

COLUMN 14

Line 1 should read: --a black image is recorded with black dots of the black ink ejected by the first nozzle unit and--;
Line 2, "records with" should be deleted;
Line 27, "graduation" should read --gradation--;
Line 52, "inks-being" should read --inks being--;
Line 61, "formed with" should read --formed by the first nozzle unit and in a region which is recordable by the first nozzle unit with--; and
Line 62, "a predetermined" should read --a second predetermined--.

COLUMN 15

Line 16, "the first nozzle units" should be deleted;
Line 17 should read: --a black image is recorded with black dots of the black ink ejected by the first nozzle unit and--;
Line 18, "records with" should be deleted; and
Line 23, "a predetermined" should read --a first predetermined--.

Signed and Sealed this

Twenty-fourth Day of November, 2009

David J. Kappos

David J. Kappos
*Director of the United States Patent and Trademark Office*